US007168384B1

(12) United States Patent
Willis

(10) Patent No.: US 7,168,384 B1
(45) Date of Patent: Jan. 30, 2007

(54) PERSONAL WATER CRAFT BRAKE APPARATUS

(76) Inventor: Charles M. Willis, 12240 Eakin St., Brooksville, FL (US) 34614

( * ) Notice: Subject to any disclaimer, the term of this patent is extended or adjusted under 35 U.S.C. 154(b) by 0 days.

(21) Appl. No.: 11/331,475

(22) Filed: Jan. 13, 2006

(51) Int. Cl.
*B63H 25/44* (2006.01)

(52) U.S. Cl. ..... 114/145 R

(58) Field of Classification Search ..... 114/145 R; 74/489

See application file for complete search history.

(56) References Cited

U.S. PATENT DOCUMENTS 3,104,559 A * 9/1963 Dotter ..... 74/489
3,272,171 A * 9/1966 Korcak ..... 114/145 R
5,775,173 A * 7/1998 Wagner ..... 74/502.2
5,988,091 A 11/1999 Willis
6,691,634 B2 * 2/2004 Fritchle ..... 114/145 R

* cited by examiner

*Primary Examiner*—Ed Swinehart

(57) ABSTRACT

A brake apparatus is provided for a water craft which has a hull. The brake apparatus includes a craft attachment unit attached to the hull of the water craft. A pair of combined hinge assembly/hinge-to-plate connection brackets is connected to the craft attachment unit. A brake plate is connected to the combined hinge assembly/hinge-to-plate connection brackets. A brake plate control assembly is connected to the brake plate. The brake plate control assembly includes a brake cable and a cable winder assembly which is connected between the brake cable and the brake plate for lifting and lowering the brake plate. The craft attachment unit is attached to a rear or stern portion of the water craft. Preferably, a return spring assembly is connected to the cable winder assembly. The return spring assembly returns the brake plate to a nonbraking mode or locked condition when braking action is no longer needed.

13 Claims, 5 Drawing Sheets

FIG 1
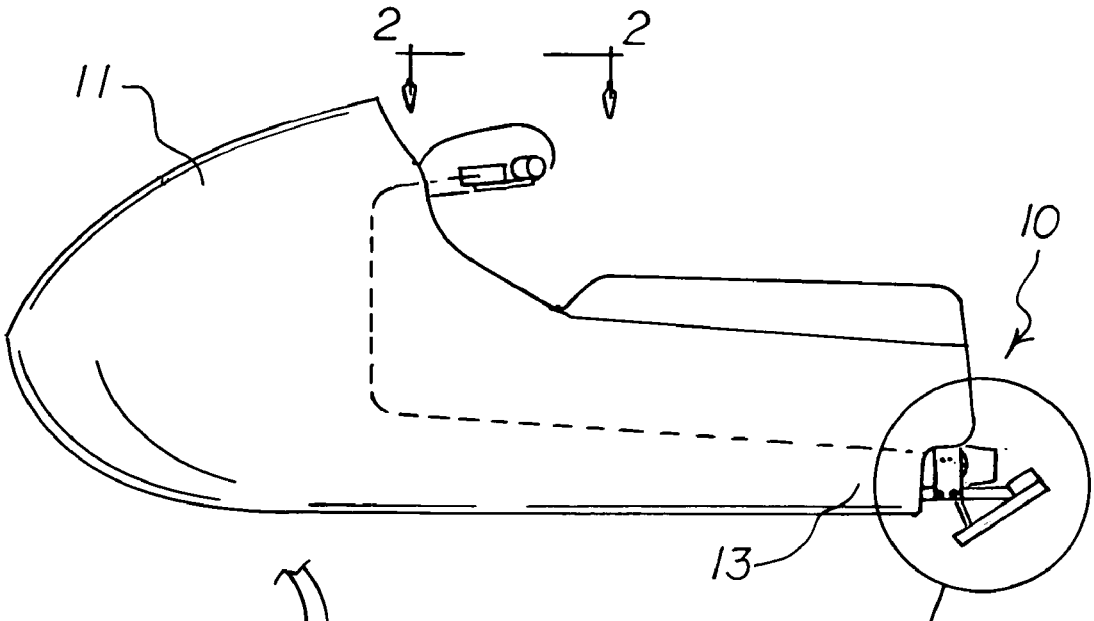
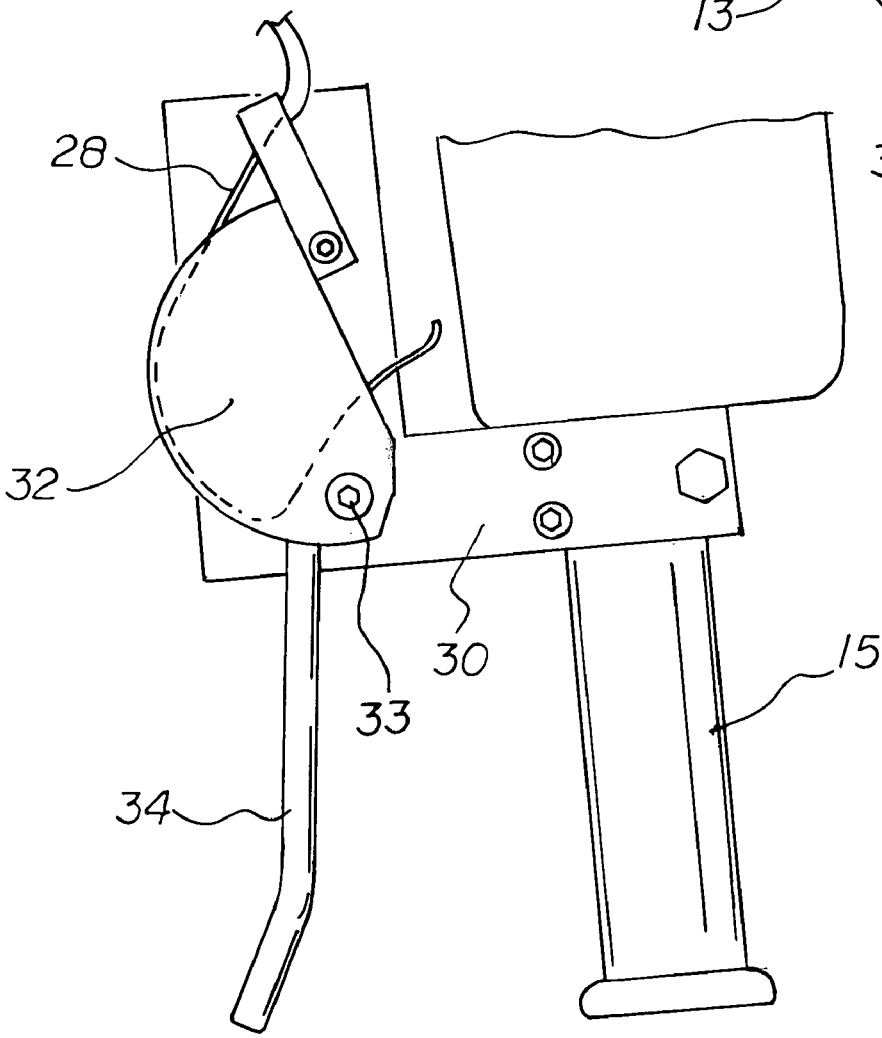
FIG 2

FIG 5
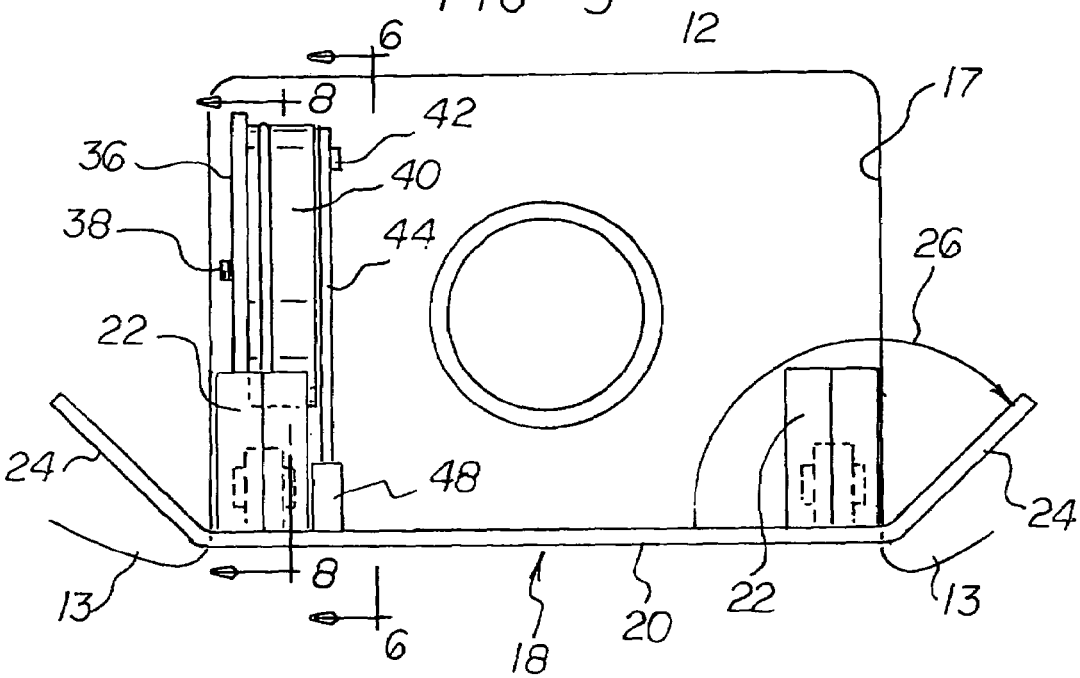
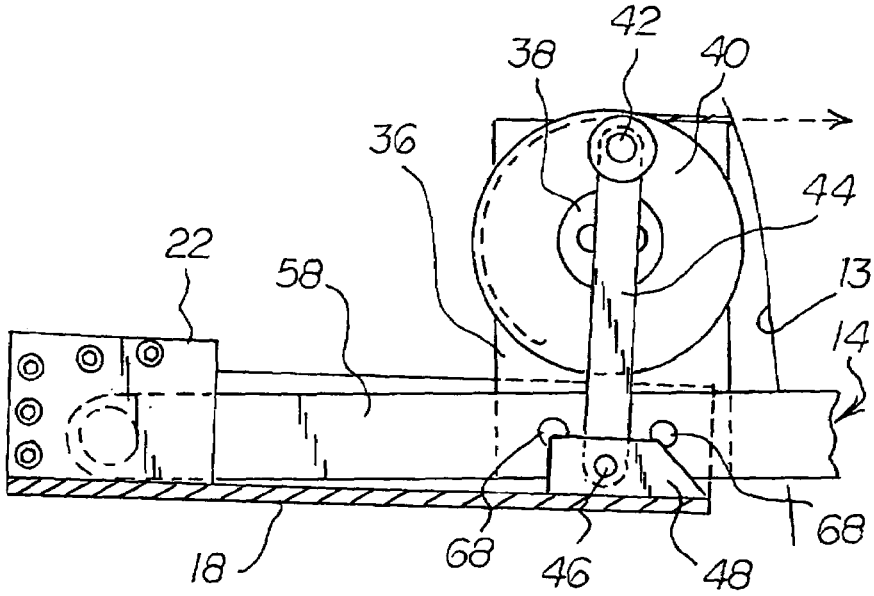
FIG 6

FIG 7
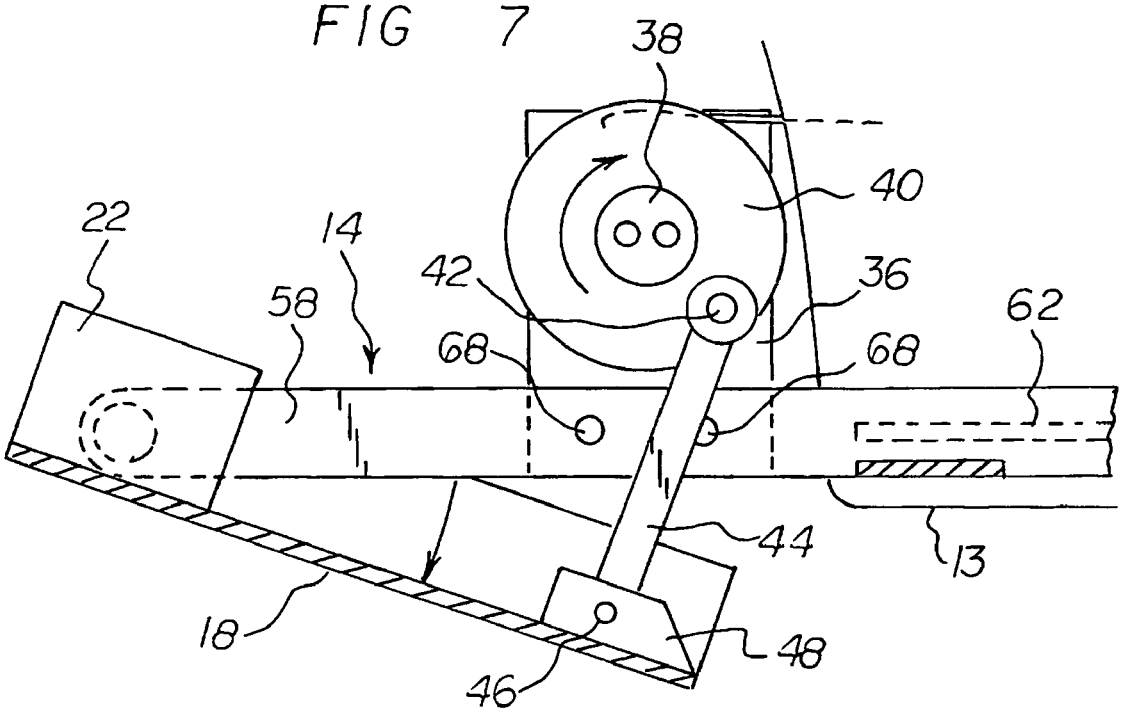
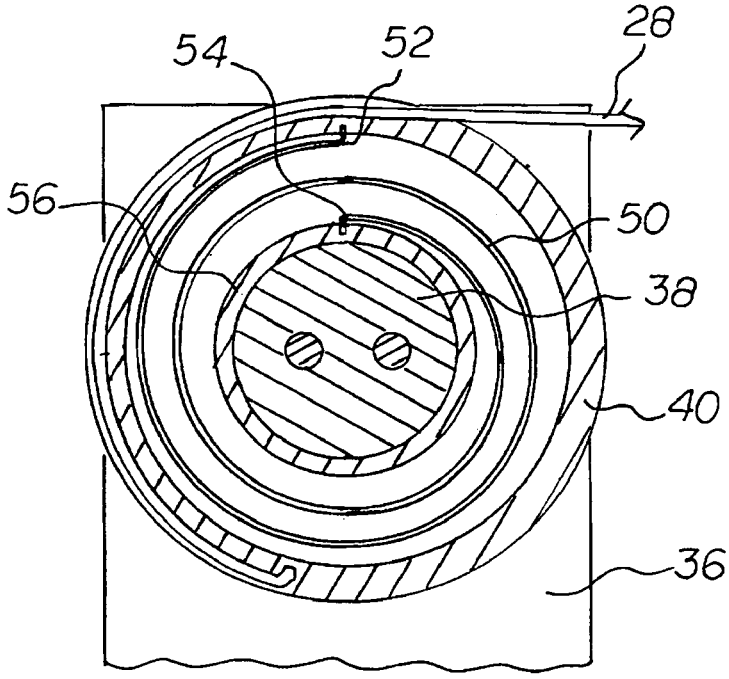
FIG 8

PERSONAL WATER CRAFT BRAKE APPARATUS

BACKGROUND OF THE INVENTION

1. Field of the Invention

The present invention relates generally to water craft and, more particularly, to devices especially adapted for braking water craft.

2. Description of the Prior Art

A type of water craft that is very popular is a personal water craft. One type of personal water craft is known as a jet ski. With a jet ski, a stream of water emerges from a nozzle at the rear of the jet ski, and the stream of water provides thrust for the jet ski. As with all water craft, slowing down and stopping a water craft may be difficult to do, especially if the water craft is moving through the water at a relatively high speed. In this respect, throughout the years, a number of innovations have been developed relating to slowing down and stopping water craft, and the following U.S. patents are representative of some of those innovations: U.S. Pat. Nos. 2,994,290, 3,209,716, 5,193,478, 5,377,610, 5,493,990, and 5,988,091.

It is noted that U.S. Pat. Nos. 2,994,290, 3,209,716, 5,193,478, 5,377,610, and 5,493,990 have been considered and discussed in U.S. Pat. No. 5,988,091, by the present inventor. In this regard, the aforementioned U.S. Pat. No. 5,988,091 hereby is incorporated herein and made part of the present specification by this reference thereto.

It is also noted that the present invention provides substantially all of the advantages set forth in U.S. Pat. No. 5,988,091. Moreover, additional advantages are set forth herein with respect to the present invention.

In U.S. Pat. No. 5,988,091, the importance of increasing drag during braking by forcing the stern of the water craft deeper into the water during braking is clearly set forth. Herein, however, some additional principles are set forth which further emphasize and support the importance of having the stern of a water craft to move deeper into the water during a braking operation.

A water craft has a center of gravity that is generally above the horizontal surface of a body of water. When the water craft is decelerated or braked, it is important that most of the drag during braking take place behind the center of gravity of the water craft. If, however, most of the drag during braking takes place in front of the center of gravity, the water craft can tilt in a forward direction and can even flip over in the forward direction. Clearly, such a catastrophe is to be avoided. In this respect, it would be desirable if a water craft brake apparatus were provided that provides lift to or at the front the water craft when the braking action takes place.

To assure that most of the drag during braking takes place behind the center of gravity of the water craft, the above-mentioned U.S. Pat. No. 5,988,091 provides a water craft braking apparatus that is located at the rear of the water craft.

Some water crafts have a rear hull cavity that receives a jet ski nozzle. In this respect, it would be desirable if a water craft braking apparatus were provided that includes components that fit into the rear hull cavity of a water craft.

Some of the embodiments of the braking apparatus set forth in U.S. Pat. No. 5,988,091 employ the rear discharge nozzle of a water ski apparatus in an interaction with the braking apparatus. Some water craft, however, do not have a rear discharge nozzle. In this respect, it would be desirable to provide a water craft brake apparatus that does not require the employment of a rear discharge nozzle.

In the embodiments of the braking apparatus set forth in U.S. Pat. No. 5,988,091, when the hand of the operator is no longer applying a braking force to the brake plate control assembly, the brake plate does not automatically return to a nonbraking position and the brake system lacks a locking mechanism. In this respect, it would be desirable if a water craft brake apparatus were provided which automatically returns a brake plate to a nonbraking position when the operator is no longer applying a braking force to the brake control assembly, and which maintains the brake assembly in a normally locked or nonbraking condition thereby preventing unintentional activation of the brake plate.

Thus, while U.S. Pat. No. 5,988,091 indicates it to be well known to use a braking apparatus at the rear end of a jet ski, U.S. Pat. No. 5,988,091 described above does not teach or suggest a personal water craft brake apparatus which has the following combination of desirable features: (1) includes components that fit into the rear hull cavity of a water craft; (2) does not require the employment of a rear discharge nozzle in the water craft; (3) automatically returns a brake plate to a nonbraking position when the operator is no longer applying a braking force to the brake control assembly; (4) causes the front of the water craft to be lifted above the water and the stern of the water craft to be downwardly directed into the water when the braking action takes place; and (5) provides locking of the brake plate in a normally nonbraking position when the control system therefor is not being operated. The foregoing desired characteristics are provided by the unique personal water craft brake apparatus of the present invention as will be made apparent from the following description thereof. Other advantages of the present invention over the prior art also will be rendered evident.

SUMMARY OF THE INVENTION

To achieve the foregoing and other advantages, the present invention, briefly described, provides a brake apparatus for a water craft which has a hull. The brake apparatus includes a craft attachment unit attached to the hull of the water craft. A pair of combined hinge assembly/hinge-to-plate connection brackets is connected to the craft attachment unit. A brake plate is transversely connected to the combined hinge assembly/hinge-to-plate connection brackets. A brake plate control assembly is connected to the brake plate. The brake plate control assembly includes a brake cable and a cable winder assembly which is connected between the brake cable and the brake plate for lifting and lowering the brake plate and for locking the brake plate in a normally nonbraking position. The craft attachment unit is attached to a rear or stern portion of the water craft.

Preferably, the brake plate includes a central brake plate portion which is connected to the combined hinge assembly/hinge-to-plate connection brackets and includes side brake plate wings connected to the central brake plate portion. The side brake plate wings are oriented with respect to the central brake plate portion at a wing-to-central orientation angle. Preferably, the wing-to-central orientation angle is approximately degrees.

The brake plate control assembly further includes a manual control assembly which is connected to one end of the brake cable. Preferably, the manual control assembly includes a mounting bracket for mounting on a steering member of the water craft. A handle-to-cable movement member is connected to the mounting bracket, and a cable-control handle is supported by the handle-to-cable movement member. The cable-control handle is connected to the brake cable.

Preferably, the cable winder assembly includes a riser support which is connected to the craft attachment unit. A rotation axle is supported by the riser support. A cable winder drum is supported by the rotation axle, wherein an end of the brake cable is connected to the cable winder drum. A first crank pin is connected to the cable winder drum. A crank rod is connected to the first crank pin. A second crank pin is connected to the crank rod. A crank-pin-reception bracket supports the second crank pin, and the crank-pin-reception bracket is connected to the brake plate.

Preferably, a return spring assembly is connected to the cable winder assembly. The return spring assembly includes a spiral or torsion spring, wherein a first end of the spiral or torsion spring is connected to the cable winder drum. A second end of the spiral or torsion spring is connected to the rotation axle. Preferably, the spiral or torsion spring is housed inside the cable winder drum. The return spring assembly is designed to return the brake plate to a nonbraking mode or locked condition when braking action is no longer needed.

Preferably, the craft attachment unit includes hinge connection spars which are connected to the combined hinge assembly/hinge-to-plate connection brackets. Bolt-reception plates are connected to the hinge connection spars, and transverse reinforcement plates are connected between the hinge connection spars.

The water craft can be a commercially available personal water craft frequently designated by the public as a jet ski.

The above brief description sets forth rather broadly the more important features of the present invention in order that the detailed description thereof that follows may be better understood, and in order that the present contributions to the art may be better appreciated. There are, of course, additional features of the invention that will be described hereinafter and which will be for the subject matter of the claims appended hereto.

In this respect, before explaining a preferred embodiment of the invention in detail, it is understood that the invention is not limited in its application to the details of the construction and to the arrangements of the components set forth in the following description or illustrated in the drawings. The invention is capable of other embodiments and of being practiced and carried out in various ways. Also, it is to be understood, that the phraseology and terminology employed herein are for the purpose of description and should not be regarded as limiting.

As such, those skilled in the art will appreciate that the conception, upon which disclosure is based, may readily be utilized as a basis for designing other structures, methods, and systems for carrying out the several purposes of the present invention. It is important, therefore, that the claims be regarded as including such equivalent constructions insofar as they do not depart from the spirit and scope of the present invention.

It is therefore an object of the present invention to provide a new and improved personal water craft brake apparatus which has all of the advantages of the prior art and none of the disadvantages.

It is another object of the present invention to provide a new and improved personal water craft brake apparatus which may be easily and efficiently manufactured and marketed.

It is a further object of the present invention to provide a new and improved personal water craft brake apparatus which is of durable and reliable construction.

An even further object of the present invention is to provide a new and improved personal water craft brake apparatus which is susceptible of a low cost of manufacture with regard to both materials and labor, and which accordingly is then susceptible of low prices of sale to the consuming public, thereby making such personal water craft brake apparatus available to the buying public.

Still yet a further object of the present invention is to provide a new and improved personal water craft brake apparatus which includes components that fit into or proximal to the rear hull cavity of a water craft.

Still another object of the present invention is to provide a new and improved personal water craft brake apparatus that does not require the employment of a rear discharge nozzle.

Yet another object of the present invention is to provide a new and improved personal water craft brake apparatus which automatically returns a brake plate to a nonbraking position when the operator is no longer applying a braking force to the brake control assembly and which maintains the brake plate in a normally locked or nonbraking position.

Even another object of the present invention is to provide a new and improved personal water craft brake apparatus that provides lift to the front of the water craft and drag to the stern of the water craft when the braking action takes place.

These together with still other objects of the invention, along with the various features of novelty which characterize the invention, are pointed out with particularity in the claims annexed to and forming a part of this disclosure. For a better understanding of the invention, its operating advantages and the specific objects attained by its uses, reference should be had to the accompanying drawings and descriptive matter in which there are illustrated preferred embodiments of the invention.

BRIEF DESCRIPTION OF THE DRAWINGS

The invention will be better understood and the above objects as well as objects other than those set forth above will become more apparent after a study of the following detailed description thereof. Such description makes reference to the annexed drawing wherein:

FIG. 1 is a side view showing a preferred embodiment of water craft brake apparatus of the invention mounted at the rear of the water craft with some of the apparatus components in the rear hull cavity.

FIG. 2 is an enlarged top view of a portion of a brake plate control assembly mounted on a manually operated portion of a steering mechanism for the water craft.

FIG. 5 is a rear view of the portion of the embodiment of the invention shown in FIG. 4, taken along line 5—5 thereof.

FIG. 6 is a cross-sectional view of the embodiment of the invention shown in FIG. 5, taken along line 6—6 thereof, wherein the brake apparatus is in a nonbraking mode.

FIG. 7 is a cross-sectional view of the embodiment of the invention shown in FIG. 6, wherein the brake apparatus is in a braking mode.

FIG. 8 is an enlarged cross-sectional view of the embodiment of the invention shown in FIG. 5, taken along line 8—8 thereof.

DESCRIPTION OF THE PREFERRED EMBODIMENT

Figure 3:
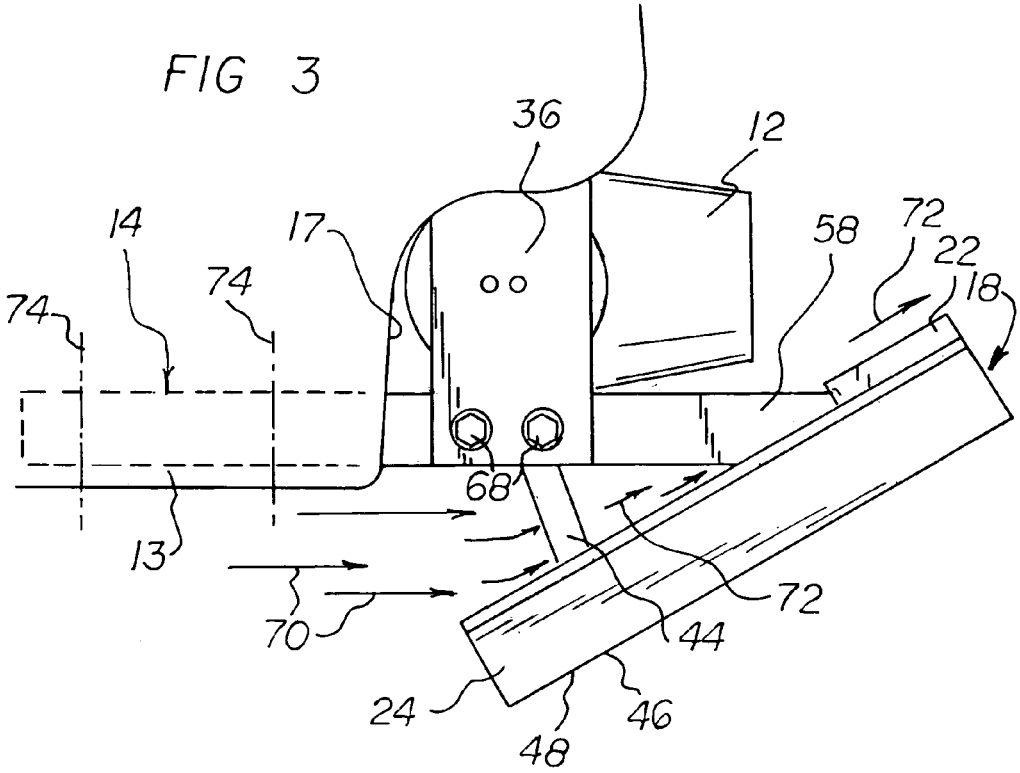
FIG. 3 is an enlarged side view of a portion of the water craft brake apparatus of the invention that is contained in circled region 3 of FIG. 1, wherein the water craft brake apparatus is in a braking mode.
Figure 3:
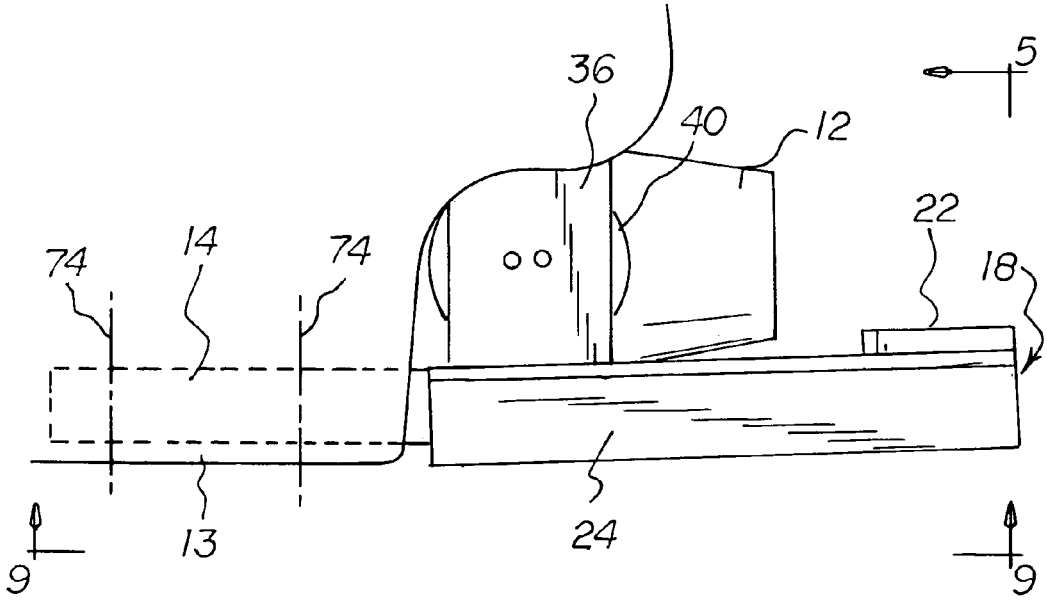

With reference to the drawings, a new and improved personal water craft brake apparatus embodying the principles and concepts of the present invention will be described.

With reference to the drawings, a new and improved personal water craft brake apparatus embodying the principles and concepts of the present invention will be described.

A brake apparatus 10 is provided for a water craft 11 which has a hull 13. The brake apparatus 10 includes a craft attachment unit 14 attached to the hull 13 of the water craft 11. A pair of transversely spaced, combined hinge assembly/hinge-to-plate connection brackets 22 is connected to the craft attachment unit 14. A brake plate 18 is connected to the combined hinge assembly/hinge-to-plate connection brackets 22. A brake plate control assembly is connected to the brake plate 18. The brake plate control assembly includes a brake cable 28 and a cable winder assembly which is connected between the brake cable 28 and the brake plate 18 for lifting and lowering the brake plate 18. The craft attachment unit 14 is attached to a rear or stern portion of the water craft 11.

Preferably, the brake plate 18 includes a central brake plate portion 20 which is rigidly connected to the combined hinge assembly/hinge-to-plate connection brackets 22 and includes side brake plate wings 24 connected to the central brake plate portion 20. The side brake plate wings 24 are oriented with respect to the central brake plate portion 20 at a wing-to-central orientation angle 26. Preferably, the wing-to-central orientation angle 26 is approximately 120 degrees. However, this angle may be varied depending upon the hull design of particular water craft. Suffice it to say the proper angle is chosen to enhance cupping action of the water as it impinges upon the brake plate portion 20 which action, in turn, enhances the efficiency of the braking action particularly with respect to driving the stern of the water craft downwardly or into the water when braking action occurs.

The brake plate control assembly further includes a manual control assembly which is connected to one end of the brake cable 28. Preferably, the manual control assembly includes a mounting bracket 30 for mounting on a steering member 15 of the water craft 11. Substantially as shown, the manual control assembly further preferably includes a handle-to-cable movement member in the form of a cam 32 suitably connected to the mounting bracket 30 via a pivot pin 33, and a cable-control handle 34 which preferably is affixed to the cam 32. The distal portion of one end of the brake cable 28 is wound about the periphery of the cam 32 and suitably securely fixed thereto (FIG. 2). The cable-control handle 34 thus is suitably connected to the brake cable 28 through pivotal cam 32 such that movement of the handle toward the steering member 15 causes movement of the cam 32 about pivot 33 and corresponding linear movement of the brake cable 28. The steering member 15 can be the steering handlebars of the water craft 11.

Preferably, the cable winder assembly includes a riser support 36 which is connected to the craft attachment unit 14. A rotation axle 38 is suitably supported by the riser support 36. A cable winder drum 40 is suitably supported on axle 38 for rotation about axle 38, wherein the other end of the brake cable 28 is connected to the cable winder drum 40 (FIGS. 6 and 8). A first crank pin 42 is connected to the cable winder drum 40. A crank rod 44 is connected to the first crank pin 42. A second crank pin 46 is connected to the crank rod 44. A crank-pin-reception bracket 48 supports the second crank pin 46, and the crank-pin-reception bracket 48 is connected to the brake plate 18. Preferably, attachment bolts 68 are used to connect the riser support 36 to the craft attachment unit 14.

Preferably, a return spring assembly is connected to the cable winder assembly. Substantially as best seen in FIG. 8, The return spring assembly includes a spiral or torsion spring 50, wherein a first end 52 of the spring 50 is suitably connected to the cable winder drum 40. As depicted, the rotation axle 38 further includes a spring anchor bushing 56 affixed thereto, and a second end 54 of the spiral or torsion spring 50 is suitably securely connected to or otherwise anchored to bushing 56 and therefore axle 38. Alternatively, the bushing 56 may be dispensed with and the second end 54 of spring member 50 suitably may be affixed directly to axle 38. Preferably, the spiral or torsion spring 50 is housed inside the cable winder drum 40. The spiral or torsion spring 50 is such as to automatically return the cable winder assembly and the brake plate 18 to a normally nonbraking or locked position when the operator is no longer applying an operable braking force to and through the brake control assembly (i.e. when the operator has released handle 34).

Preferably, the craft attachment unit 14 includes hinge connection spars 58 which are connected respectively to the pair of combined hinge assembly/hinge-to-plate connection brackets 22. Each spar 58 is connected to each respective bracket 22 in such a way that the distal end of each spar is suitably journalled for rotation therein in a well known manner. Further, each spar 58 extends axially and longitudinally from its journalled connection inside each respective hinge assembly 22 through a front-facing vertical slot therein substantially as shown in FIGS. 5–7 and 10. Bolt-reception plates 60 are connected to the hinge connection spars 58, and transverse reinforcement plates 62 are connected between the hinge connection spars 58. Mounting bolts 64 are used to attach the craft attachment unit 14 to the hull 13 of the water craft 11. The mounting bolts 64 can be installed in the hull 13 along mounting-bolt axes 74 shown in FIGS. 3 and 4. The bolt-reception plates 60 includes bolt-reception channels 66 for receiving the mounting bolts 64.

The water craft 11 can be a commercially available jet ski such as the Kawasaki Ultra 150 personal water craft (PWC). As is well known, such water craft feature a hull cavity at the rear thereof opening through the bottom of the hull which bottom opening is covered by a removable, generally horizontally disposed metal ride plate sized to cover the bottom opening and thereby provide a smooth drag-reducing surface across the bottom of the hull (in lieu of the aforementioned bottom hull opening which tends to increase drag if left open). The conventional ride plate, in turn, typically is bolt-fastened to the bottom opposed sides of the hull through a series of bolt-receiving receptacles proximal to the opposed hull edge portions defining the opening. It is within the contemplation of the present invention to provide the bolt-reception channels 66 on plates 60 in the same pattern as the ride plate bolt-receiving receptacles already provided on the water craft and to securely fasten the bolt-reception plates 60 (and therefore spars 58 and attachment unit 14)

directly to the hull via suitable bolts received in the ride plate bolt-receiving receptacles. Preferably, this advantageously may be accomplished by first removing the ride plate, positioning the bolt-reception channels 66 over the ride plate bolt-receiving receptacles, and next re-installing the ride plate using the ride plate fastening bolts (e.g. such as bolts 64). In this manner, the bolt-reception plates 60 will be sandwiched between the hull and the re-installed ride plate and held securely in place by the normally provided ride plate bolts (e.g. such as bolts 64).

To use the brake apparatus 10 of the invention, and as mentioned above, at the rear end of the water craft 11, the bolt-reception plates 60 are mounted to the hull 13 of the water craft 11 using mounting bolts 64. The bolt-reception plates 60 are positioned on the hull 13 so that the brake plate 18 extends behind the rear of the hull 13 and so that the cable winder assembly is located proximal to the rear hull cavity 17, substantially as shown in FIGS. 1–3.

Figure 4:
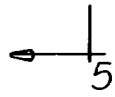
FIG. 4 is a side view of the portion of the water craft brake apparatus of the invention that is shown in FIG. 3, wherein the water craft brake apparatus is in a nonbraking or normally locked mode.
Figure 9:
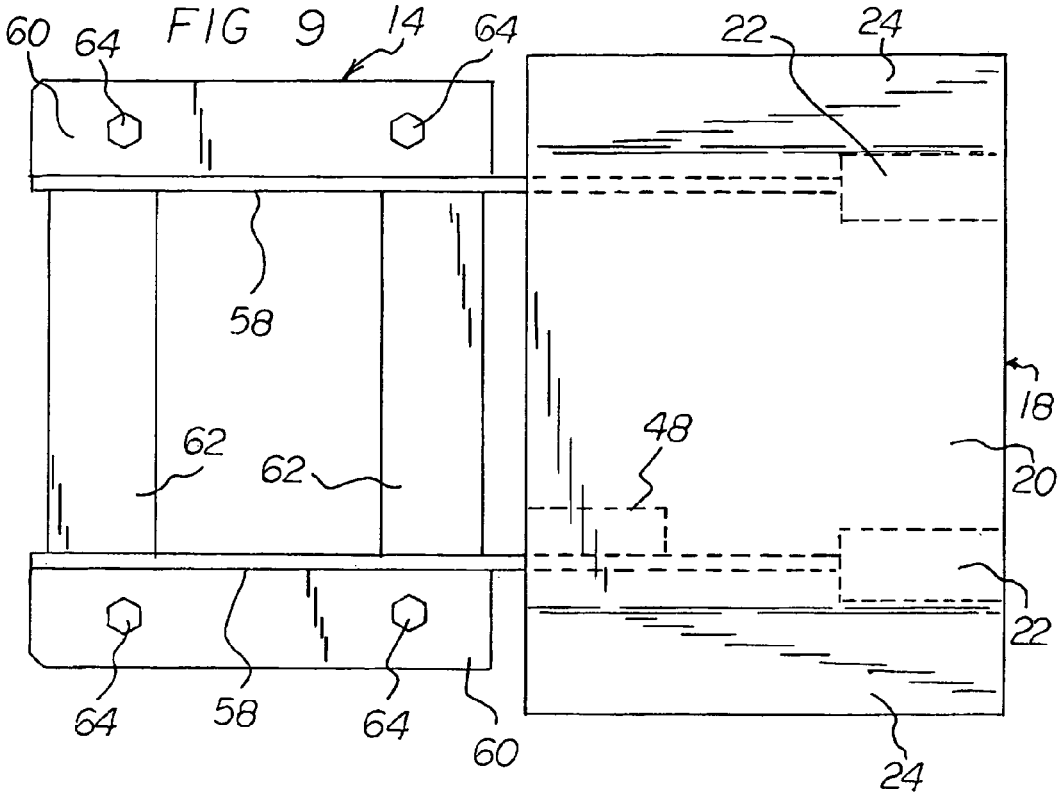
FIG. 9 is a bottom view of the portion of the embodiment of the invention shown in FIG. 4, taken along line 9—9 thereof.
Figure 10:
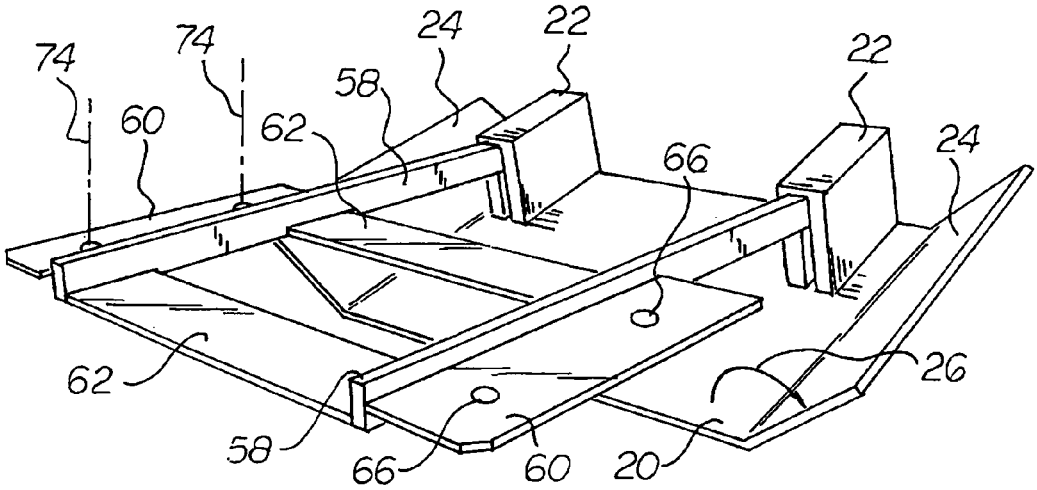
FIG. 10 is a front perspective of the portion of the embodiment of the invention shown in FIG. 9, removed from the jet ski apparatus.

When the brake apparatus 10 is not is operated, as shown in FIGS. 4 and 6, the brake plate 18 is in a substantially horizontal orientation. In the horizontal orientation, the brake plate 18 does not cause any substantial drag on the water craft 11 as the water craft 11 is driven on a body of water.

However, when the operator of the water craft 11 desires to decelerate the water craft 11, the operator squeezes the cable-control handle 34, which causes the rotation of cam 32 and corresponding movement of the brake cable 28. As the brake cable 28 moves, as shown in FIG. 8, the brake cable 28 causes the cable winder drum 40 to rotate around the rotation axle 38. This is the braking mode of the brake apparatus 10 of the invention.

As shown in FIG. 7, with the braking mode, as the cable winder drum 40 rotates around the rotation axle 38, the first crank pin 42 also rotates around the rotation axle 38, whereby the first crank pin 42 and the crank rod 44 are pushed downward. As the crank rod 44 is pushed downward, the crank rod 44 pushes against the second crank pin 46, which causes the brake plate 18 to be lowered to a position below the bottom of the hull 13.

As shown in FIG. 3, in the braking mode, when the brake plate 18 is below the bottom of the hull 13, water flowing under the hull 13, as indicated by directional arrows 70, is redirected into an upward motion, as indicated by directional arrows 72. With water flowing in the upward direction, the physical law of "for every action there is an equal but opposite reaction" (Newton's Third Law) is in effect, and the brake plate 18 is pushed downward by the upwardly flowing water.

In the braking mode shown in FIG. 3, the brake plate 18 causes increased drag on the water craft 11, thereby bringing about deceleration of the water craft 11. In addition, when the brake plate 18 is in the braking mode, the entire rear end of the hull 13 is lowered in the water. Therefore increased braking action is realized by increased drag of the lowered hull 13 in the water. Moreover, with the rear end of the hull 13 is lowered in the water, the front end of the hull 13 is raised out of the water, thereby reducing drag on the front end of the hull 13 and preventing the water craft 11 from flipping over in a forward direction.

Also, as the cable-control handle 34 is operated by the operator and the cable winder drum 40 is caused to rotate sufficiently thereby positioning the brake plate 18 in the braking mode, the spiral or torsion spring 50 becomes compressed inside the winder drum 40. That is, the operator, in squeezing the cable-control handle 34, must exert enough force to both lower the brake plate 18 and overcome the compressive spring force or resilient bias of the spiral or torsion spring 50. As the front edge of the braking plate begins to lower into the water by the action of handle 34, the braking plate effectively is "caught" by the impinging water force and this force helps to counteract the spring resistance of spiral or torsion spring 50 thereby urging the plate to lower even more into the water until it reaches its most-downward point (FIGS. 4 and 7). In this regard, it will be noted that the maximum downward translation of the braking plate is limited by the engagement of the top edge portions of spars 58 against the top of each respective hinge block 22 (see also FIG. 10). If desired, this downward movement may be adjusted by placing a horizontally disposed adjustment pin or bolt (not shown) in the upper portion of each hinge block 22.

After, the braking operation is complete, the operator releases the cable-control handle 34, and the spiral or torsion spring 50 is free to relax and automatically returns the cable winder drum 40 and the brake plate 18 to the nonbraking or locked mode. That is, the spiral or torsion spring 50 returns the brake plate 18 to the horizontal orientation shown in FIG. 4 and in this condition the spring still has an inherent compressive force or bias tending to keep the winder drum in its normal or nonrotated position. In this nonbraking mode, therefore, and in accordance with the present invention, there is a sufficient inherent spring bias in spiral or torsion spring member 50 to maintain or lock the brake plate in the horizontal orientation shown in FIG. 4.

The components of the personal water craft brake apparatus of the invention can be made from inexpensive and durable metal and plastic materials.

As to the manner of usage and operation of the instant invention, the same is apparent from the above disclosure, and accordingly, no further discussion relative to the manner of usage and operation need be provided.

It is apparent from the above that the present invention accomplishes all of the objects set forth by providing a new and improved brake apparatus for a water craft that is low in cost, relatively simple in design and operation, and which may advantageously be used to increase drag by forcing the stern of the water craft deeper into the water. With the invention, a brake apparatus for a water craft is provided which is under the control of the operator of the water craft. With the invention, a brake apparatus for a water craft is provided which easily fits onto a water craft having a conventional hull for easy retrofitting of the water craft with the brake apparatus. Also, with the invention, a brake apparatus for a water craft is provided which includes components that fit into the rear hull cavity of a water craft. With the invention, a brake apparatus for a water craft is provided which does not require the employment of a rear discharge nozzle. With the invention, a brake apparatus for a water craft is provided which automatically returns a brake plate to a nonbraking position when the operator is no longer applying a braking force to the brake control assembly. With the invention, an apparatus is provided that provides lift to the front of a water craft and causes the stern of the water craft to be downwardly directed into the water when the braking action afforded by the apparatus takes place. With the invention, an apparatus is provided that provides locking of the brake plate in a normally nonbraking position when the control system therefor is not being operated.

Thus, while the present invention has been shown in the drawings and fully described above with particularity and detail in connection with what is presently deemed to be the most practical and preferred embodiment(s) of the invention, it will be apparent to those of ordinary skill in the art that many modifications thereof may be made without departing from the principles and concepts set forth herein, including, but not limited to, variations in size, materials, shape, form, function and manner of operation, assembly and use.

Finally, it will be appreciated that the purpose of the annexed Abstract is to enable the U.S. Patent and Trademark Office and the public generally, and especially the scientists, engineers and practitioners in the art who are not familiar with patent or legal terms or phraseology, to determine quickly from a cursory inspection the nature and essence of the technical disclosure of the application. Accordingly, the Abstract is neither intended to define the invention or the application, which only is measured by the claims, nor is it intended to be limiting as to the scope of the invention in any way.

The invention claimed is:

1. A brake apparatus for a water craft which includes a hull, comprising:

a craft attachment unit adapted to be attached to the hull of the water craft, at least one hinge assembly/hinge-to-plate connection bracket connected to said craft attachment unit, a brake plate connected to said at least one of said combined hinge assembly/hinge-to-plate connection brackets, and a brake plate control assembly connected to said brake plate, said brake plate control assembly adapted to be operable by an operator of said water craft between a first locked or nonbraking condition and a second braking condition where said brake plate is moved relative to said hull to cause braking of said water craft, wherein said brake plate control assembly includes a brake cable, and a cable winder assembly connected between said brake cable and said brake plate for moving said brake plate, said cable winder assembly including a resilient member for automatically maintaining said brake plate in said first or nonbraking condition.

2. The apparatus of claim 1 wherein said craft attachment unit is attached to a stern portion of the water craft.

3. The apparatus of claim 1 wherein said brake plate includes:

a central brake plate portion connected to said at least one combined hinge assembly/hinge-to-plate connection bracket, and side brake plate wings connected to said central brake plate portion, wherein said side brake plate wings are oriented with respect to said central brake plate portion at a wing-to-central orientation angle.

4. The apparatus of claim 3 wherein said wing-to-central orientation angle is approximately 120 degrees.

5. The apparatus of claim 1 wherein said brake plate control assembly further includes a manual control assembly connected to one end of said brake cable.

6. The apparatus of claim 5 wherein said manual control assembly includes:

a mounting bracket for mounting on a steering member of the water craft, a handle-to-cable movement member connected to said mounting bracket, and a cable-control handle supported by said handle-to-cable movement member, wherein said cable-control handle is connected to said brake cable.

7. The apparatus of claim 1 wherein said craft attachment unit includes:

at least one hinge connection spar connected to said at least one combined hinge assembly/hinge-to-plate connection bracket, at least one bolt-reception plate connected to said at least one hinge connection spar, said bolt reception plate being adapted to be attached to said hull of said watercraft.

8. The apparatus of claim 1 wherein the water craft is a jet ski.

9. The apparatus of claim 6 wherein said a handle-to-cable movement member comprises a cam pivotally mounted on said mounting bracket, and said one end of said brake cable is attached to said cam so as to be moved thereby when said cable-control handle is operated by said operator.

10. A brake apparatus for a water craft which includes a hull, comprising:

a craft attachment unit adapted to be attached to the hull of the water craft, at least one hinge assembly/hinge-to-plate connection bracket connected to said craft attachment unit, a brake plate connected to said at least one of said combined hinge assembly/hinge-to-plate connection brackets, and a brake plate control assembly connected to said brake plate, said brake plate control assembly adapted to be operable by an operator of said water craft between a first locked or nonbraking condition and a second braking condition where said brake plate is moved relative to said hull to cause braking of said water craft, and wherein said cable winder assembly includes:

a riser support connected to said craft attachment unit, a rotation axle supported by said riser support, a cable winder drum supported by said rotation axle, wherein an end of said brake cable is connected to said cable winder drum, a first crank pin connected to said cable winder drum, a crank rod connected to said first crank pin, a second crank pin connected to said crank rod, and a crank-pin-reception bracket supporting said second crank pin, wherein said crank-pin-reception bracket is connected to said brake plate.

11. The apparatus of claim 10, further including:

a return spring assembly connected to said cable winder assembly.

12. The apparatus of claim 11 wherein:

said return spring assembly includes a spiral spring, wherein a first end of said spiral spring is connected to said cable winder drum, and wherein a second end of said spiral spring is connected to said rotation axle.

13. The apparatus of claim 12 wherein said spiral spring is housed inside said cable winder drum.

* * * * *